US005165759A

United States Patent [19]

Lewis, Jr.

[11] Patent Number: 5,165,759

[45] Date of Patent: Nov. 24, 1992

[54] FUSING MACHINE

[75] Inventor: John C. Lewis, Jr., Salisbury, Vt.

[73] Assignee: Tucel Industries, Inc., Forest Dale, Vt.

[21] Appl. No.: 863,542

[22] Filed: Apr. 6, 1992

Related U.S. Application Data

[63] Continuation of Ser. No. 727,363, Jul. 9, 1991, abandoned, which is a continuation of Ser. No. 449,189, Dec. 13, 1989, abandoned.

[51] Int. Cl.[5] ..... A46D 1/08

[52] U.S. Cl. ..... 300/21

[58] Field of Search ..... 300/21, 7, 5, 2

[56] References Cited

U.S. PATENT DOCUMENTS

| | | |
|---|---|---|
| Re. 27,455 | 9/1966 | Lewis, Jr. . |
| 2,433,191 | 12/1947 | Baumgartner . |
| 3,059,972 | 10/1962 | Schmidt . |
| 3,471,202 | 10/1969 | Lewis, Jr. . |
| 3,910,637 | 10/1975 | Lewis, Jr. . |
| 4,009,910 | 3/1977 | Lewis, Jr. . |
| 4,109,965 | 8/1978 | Lewis, Jr. . |
| 4,255,224 | 3/1981 | Lorenz . |
| 4,693,519 | 9/1987 | Lewis, Jr. . |
| 4,696,519 | 9/1987 | Lewis, Jr. . |
| 4,772,073 | 9/1988 | Lewis, Jr. . |

*Primary Examiner*—Mark Rosenbaum
*Assistant Examiner*—Frances Chin
*Attorney, Agent, or Firm*—Lowe, Price, LeBlanc & Becker

[57] ABSTRACT

A brush making apparatus and method for assembling tufts of synthetic filament and for mounting the same on a brush back is described. The device includes a stock box having a front plate with an aperture therein and an open back with a flapper thereon. At least one hollow elongated picking element is provided which is dimensioned to be received through the aperture. The element is initially indexed through the aperture until it abuts the ends of filaments received in the box. Forward movement is then stopped. The flapper is then energized and a second indexing movement is provided wherein the element passes through the stock box receiving a plurality of filaments therein to form the tuft. Forward movement is then stopped and the flapper deenergized. The picking element is then retracted through the stock box and through the aperture to withdraw a tuft of filament therefrom.

5 Claims, 5 Drawing Sheets

FUSING MACHINE

This application is a continuation application of application Ser. No. 07/727,363, filed Jul. 9, 1991, now abandoned, which was a continuation of Ser. No. 07/449,189 filed Dec. 13, 1989, now abandoned.

BACKGROUND OF THE INVENTION

The need for improving brush making equipment can best be described by comparing and describing conventional staple-set machinery and fusing machinery with the new and improved machinery of this invention.

Conventional staple-set brush picking machinery (forming filament tufts) employs a picker means which removes only a single filament tuft at a time from a stock box or feed mechanism by first entering the stock box approximately at its mid-section (lateral to the parallel filament) and assembling or picking a given amount of filament at the filaments mid-section. Such filament stock boxes are disclosed in brush machinery patents, for example, U.S. Pat. Nos. 2,433,191 (Baumgartner) and 3,059,972 (Schmidt).

The picker then proceeds to transport the predetermined volume of the parallel filament to a suitable means for doubling the filament at its mid-section, just prior to stapling, thus resulting in a tuft having a U-shaped configuration, wherein both ends of an individual filament are located at the working end of the resultant. A staple or anchor is then inserted through the U-shaped loop and the tuft is forced into a pre-drilled or molded hole in a brush block.

The conventional fusing brush machinery (forming all the filament tufts in a given brush simultaneously) employs a picking device made up of one or more picking elements which move in one direction into a mass of pre-cut synthetic filament parallel to the filaments' length and removes all the necessary tufts required for a given brush Such picking devices and machinery are disclosed in brush patents, for example, U.S. Pat. Nos. 3,471,202 (Lewis), Re. 27,455 (Lewis), 4,255,224 (Lorenz) and 4,693,519 (Lewis). Also, there have been various improvements in picking devices, stock boxes, but the one major problem which this instant invention overcomes is the ability to insert a picking device containing at least one picking element into a filament stock box to select the proper predetermined amount of cut-to-length filament at its end. Filling the picking element in one instant of time without causing stray individual filament strands, which first come into contact with the front-end of the picking element, to become pushed through the mass of parallel filament by the picker element as it works its way into the mass of said filament towards the back of the stock box is a major problem. This causes the stray filaments to bend over and/or (1) fall out of the rear of said stock box; (2) move out of parallel attitude causing the mass of parallel filaments to mix in all directions; and (3) bend so that when the picking device is retracted from the stock box the filaments contained within the picking element or elements are held by the stray bent individual filament, thus causing the filaments within the picking element to remain in the stock box.

Individual filaments that become bent, misaligned or disoriented within the said stock box cause voids and pockets of unaligned filament. This then causes picking misses or unfilled picker elements In order to keep the unpicked filament parallel and flowing through the stock box, it becomes necessary to constantly clean the bent and disoriented filament from the mass by pulling out the bent pieces, and aligning the parallel relationship of the remaining mass without disrupting the density of the unpicked filament during each subsequent picking cycle.

Improvements in filament flow through stock boxes have been disclosed in U.S. Pat. Nos. 4,693,519 (Lewis) and 4,696,519 (Lewis) and are hereby incorporated by reference.

To date, all longitudinal picking of cut-to-length brush filament has been a single, one-motion index of a picking element into and through the filament stock box while simultaneously causing the filament, within the said box, to oscillate back and forth from front to back of the box.

SUMMARY OF THE INVENTION

The instant invention achieves improved picking of tufts by timing the picking element with the energizing of the filament, as well as maintaining a specific density level within the contained filament during picking. As a first step, the picking element is indexed up to and through the front aperture plate to contact the filament contained within said stock box. The forward indexing movement is then stopped or delayed, and then the energized forward motion of the picking element is resumed through said filament while energizing the filament in the stock box from its working ends. The energized filaments either move toward the outer edges and away from the individual picking element or align themselves with the opening in the picking element in order to be engaged by said element and be received therein. No individual filaments then remain stationary or remain at or in alignment with the outside edge of the picking element during this step. Filaments then are not pushed forward and out the rear of the stock box bent or twisted within the box by the picking element.

The completely filled picker element with all the necessary filament tufts for the brush construction is then indexed out of the stock box and onto a filament-end melting device, while a brush element block is melted simultaneously, and the picker device is further indexed onto the pre-melted brush element block allowing the fused ends to be aligned with the melted portion of the brush element substrate Upon cooling the filament tufts will be welded onto the substrate to form a tufted fused brush construction.

OBJECT OF THE INVENTION

Objects and advantages of the invention will be set forth in part hereinafter and in part will be obvious herefrom, or may be learned by practice with the invention, the same being realized and attained by means of the combinations, compositions and improvements described herein.

While this invention is primarily concerned with new and novel filament control means during the picking and dispensing of cut-to-length synthetic filament for subsequent formation into tufted fused brush constructions, it should be realized that the principles of this invention are attained only through the novel combination of retaining said cut-to-length parallel synthetic filament and dispensing those filaments in situations wherein (1) single filament tufts are formed, (2) multiple filament tufts are formed, (3) complete tufted brush-type constructions are simultaneously formed, and (4)

continuous modular tufted strip-type brush constructions are formed.

Accordingly, it is an object of this invention to provide a new and novel means for picking tufts from filament stock boxes.

It is another object of this invention to provide double acting indexing means which, during picking, insures the complete filling of the picking elements.

It is a further object of this invention to provide new methods of picking synthetic filament from a stock box whereby the contained filament does not become disoriented or bent during the indexing of the picking element into said stock box by employing the new and useful features of the types set forth in the foregoing objects, and will become obvious to those skilled in the art with reference to the drawings and following description.

DEFINITIONS

Figure 1:
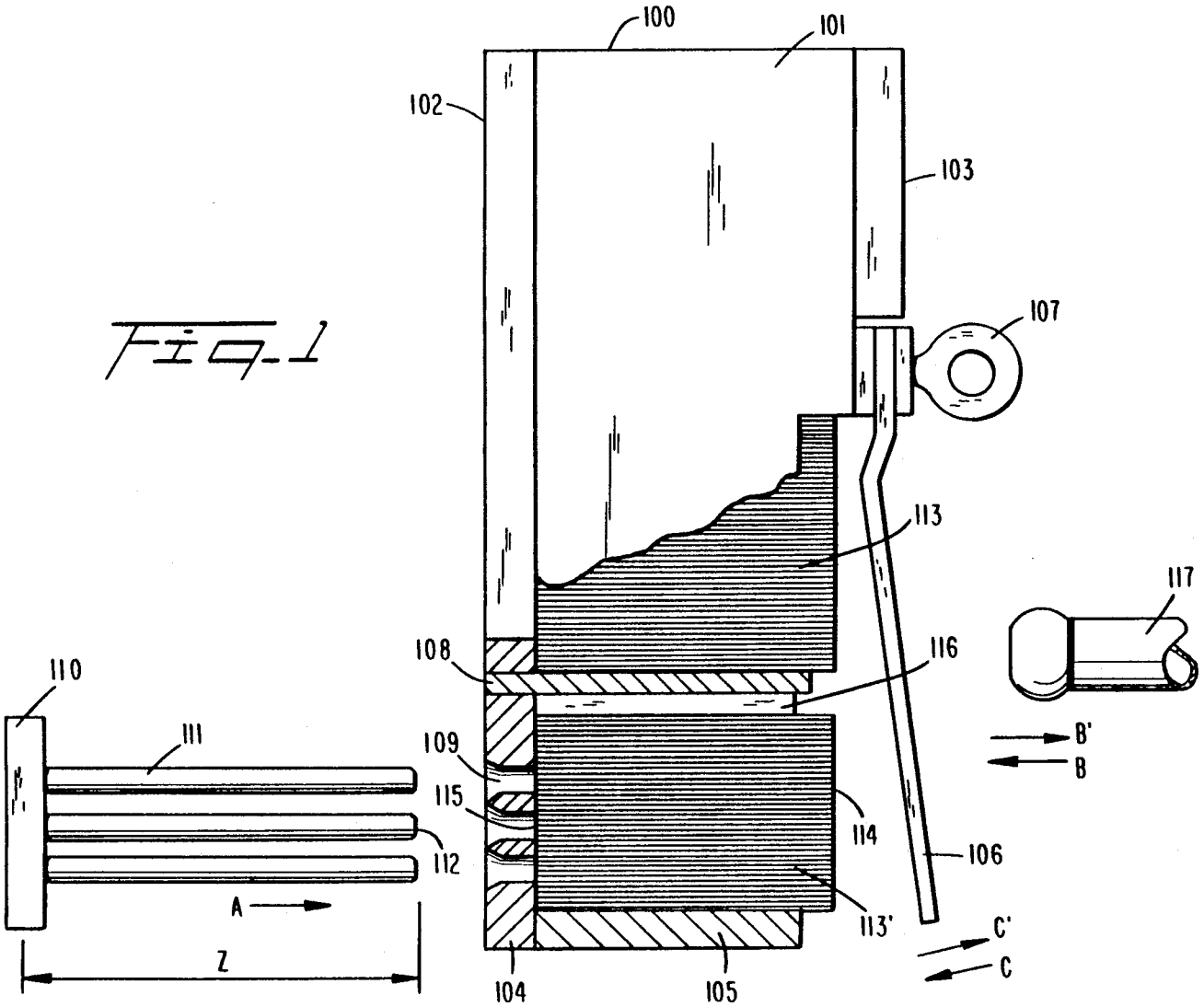
FIG. 1 is a side view of the picking device and filament stock box having a portion of the side wall removed prior to indexing.
Figure 2:
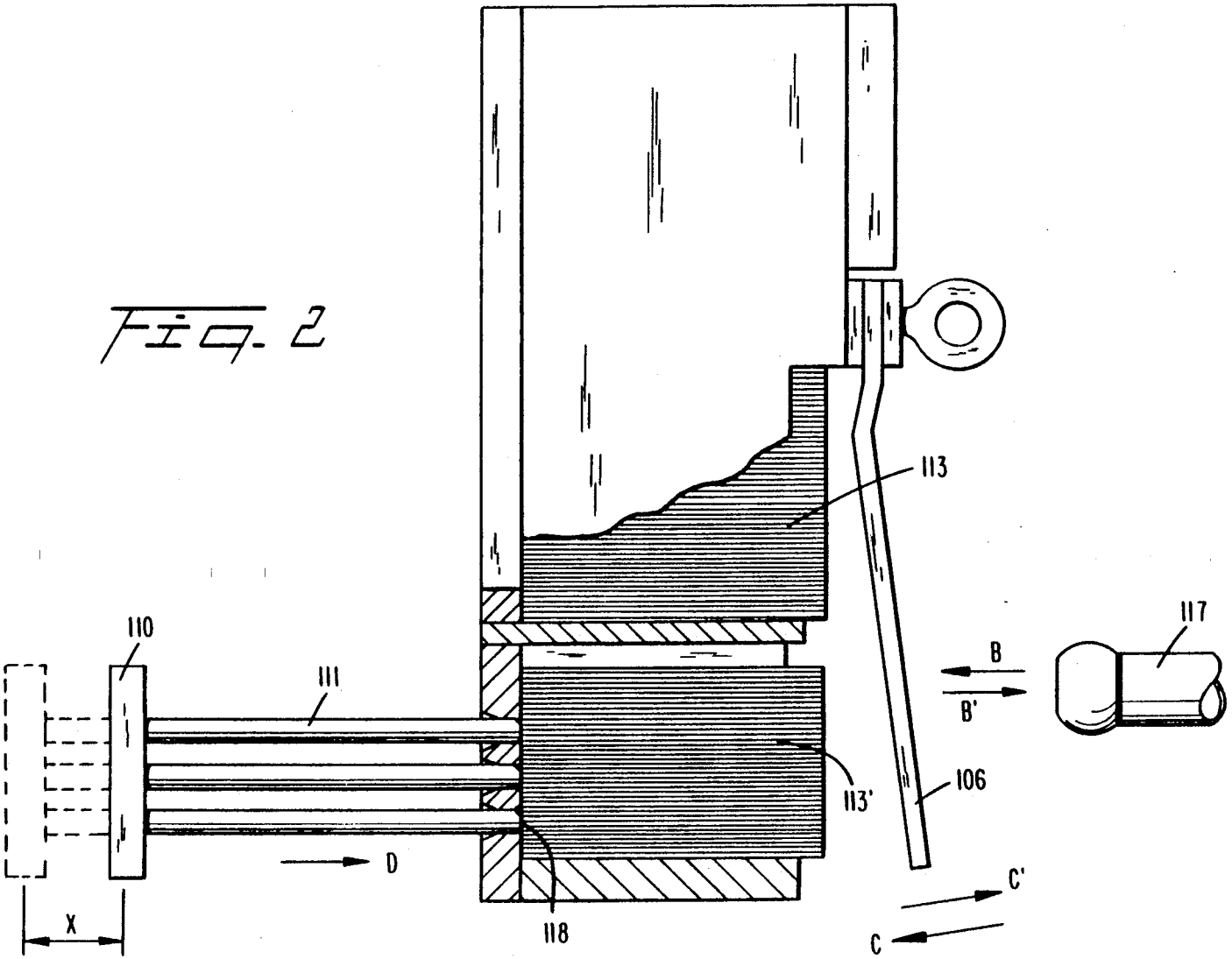
FIG. 2 is a side view of the picking device and filament stock box having a portion of the side wall removed showing the position of the picking device at the time of the first index.

The term "synthetic" filament as used hereinafter includes synthetic monofilaments which are formed from linear thermoplastic polymers from the group consisting of polystyrene and polystyrene co-polymers, polyvinyl chloride and polyvinylchloride-acetate co-polymers, polyethylene, polypropylene, polyethylene-polypropylene co-polymers, polyamides, polyesters and polyurethane. Both oriented and unoriented monofilaments may be employed Also, various filament cross-sections may be imparted to the monofilaments, such as for instance, i.e., circular, lobular, trifoil, X, and Y cross-sections, triangular, polygonal, star, etc. Mixtures of synthetic filaments may be employed in cases where the compositions of the filaments are compatible during any fusing operations, i.e., heat-sealing. Such filaments may also have suitable crimp imparted to their length or a portion thereof. Filaments may contain organic or inorganic modifications in order to make them biodegradable, or self-decomposing during or after use for a given period of time.

The term "picking" as used in the specification refers to the formation of filament tufts wherein two or more tufts are formed simultaneously by longitudinally engaging more than one cut-to-length filament at its end and removing said filament from a parallel disposed bundle of filaments. The picking devices employed are those types which are disclosed in the aforementioned U.S. Pat. No. 3,471,202, as well as picking elements disclosed in U.S. Pat. Nos. 3,910,637 (Lewis), 4,009,910 (Lewis) and 4,109,965 (Lewis). Accordingly, the disclosures of these patents are hereby incorporated by reference.

The term "apertures" as used in the specification refers to an opening in the face or front of the stock box. Said opening allows entrance of the picker element into the filaments contained therein The aperture(s) correspond(s) in cross-section to the cross-section of the picker device.

The term "choke means" as used in the specification refers to any means located within the filament stock box which allows the control in flow of the filament from the large filling reservoir to the picking zone where the apertures are located. Choke means may be stationary and/or adjustable, depending upon the versatility and use of the stock box for more than one kind of filament simultaneously. Such choke means are disclosed in U.S. Pat. Nos. 4,693,519 and 4,772,073 (Lewis). Said patent disclosures are hereby incorporated by reference.

The term "filament void" refers to an area directly under the choke means wherein the filament level fluctuates during the picking operation. It is contemplated that filament which passes through the choke means will rise to occupy the void during the energizing (vibration) phase of the picking operation.

The term "energizing" or (vibration) refers to the process of imparting energy to the non-working end of the filament during the indexing of the picker device into the filament stock box in order to fill the picker(s) element(s).

The term "index" refers to motion of the picking device toward or away from the stock box during the picking phase of tufting. To date, all disclosure of any forward motion of a picking means, device or other tufting apparatus has stated or inferred that the picking element is advanced forward into a filament mass, in one instant of time, either with or without the need of any vibration or energizing of the filament. Thus the picking element was described as passing through the face of the stock box in a continuous and forward motion to the back of the stock box, stopping and then backing out with the retained filament contained within the picking element.

DISCLOSURE OF THE EMBODIMENTS

The stock box and picking device of FIG. 1 comprises first the stock box 100 having two sides 101, a bottom 105, front upper section 102, rear upper section 103 and a front aperture plate 104 with aperture openings 109. A choke means 108 is located internally which retains filament 113 from cascading into the open area 116 just below choke means 108, while a movable plate 106 is attached to the two sides 101 by means of fixture screws 107. Filament is located just under choke means 108 and has a non-working end 114 (at the rear of the stock box) and a working end 115. The filament is in parallel attitude but not as densely packed as filament 113 above the choke means 108.

There is a vibration means 117 located opposite the movable plate 106, which when energized, moves in the forward and backward directions [B] causing movable plate 106 to vibrate or oscillate in opposite directions [C], and in so doing, causes the plate 106 to engage (come up to) the non-working ends 114 of said filament and impart energy into the mass of filament.

The picking device 110 has picker elements 111 located thereon, with open ends 112 for engaging and filling with filament during the indexing in direction [A]

of said picking device 110. The total index length or travel of the picking device 110 will be (Z}during picking. {Z} is made up of {X}+{Y} and constitutes the total distance needed for the double acting picking sequence of the instant invention.

In order to fully illustrate the preferred embodiment of the instant invention, it is necessary to describe the different stages of operation, namely the picking sequence related to tuft formation. Referring now to FIGS. 1-5, by reference characters, the first stage of picking can be accomplished with the picking device 110 in a neutral attitude and at a given distance {Z} away from but in front of and in alignment with the front face aperture plate 104 and apertures 109 thereon.

As picking begins, the picking device 110 moves forward in direction [A] by indexing {X} amount which just allows picking elements 111 with open front ends 112 to enter, through front face 104, apertures 109 and come to stop by touching (or contacting) the working ends 115 of certain filament 118 contained in said stock box 100. At the end of the index stroke {X}, the indexing actually ceases for a measurable amount of time, i.e., 0.20 seconds. The delay time depends upon many factors ranging from type of filament employed, its diameter, cross-sectional shape, choking, and the like.

The picking process continues by causing simultaneously the continued forward indexing in direction [D] of the picking device 110 over the distance (travel) {Y} while energizing means 117 moves to and from in direction [B] in turn causing movable plate 106 to vibrate back and forth in direction [C]. During this instant of time the filament is energized by said plate 106 and allowed to orient itself at or near the openings 112 of the picking elements 111, and said filaments are allowed to enter while the forward movement continues the distance {Y}. No individual filaments 113 are caused to be bent, pushed forward and out of the rear of the stock box 100, or misaligned in other directions other than their original parallel relationship by using this procedure.

Figure 3:
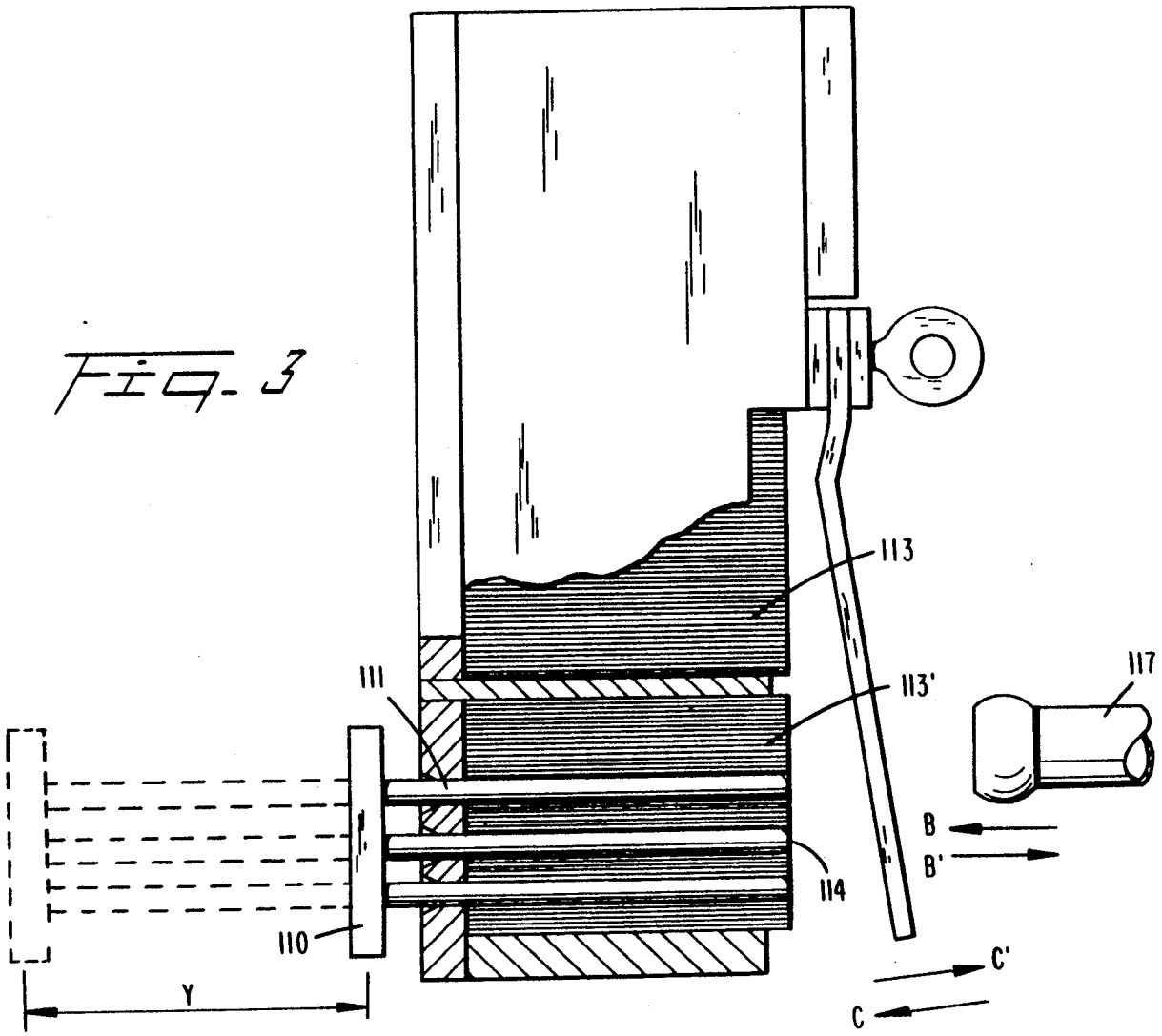
FIG. 3 is a side view familiar to FIGS. 1 and 2 of the picking device and filament stock box after energizing during the second index prior to withdrawal from the stock box.

It is noted that the space 116 has disappeared from FIG. 3 during the second stage of picking due to the fact that the picking elements 111 take up and occupy space between individual filaments. It is this ability of the filament to become energized, move freely around in parallel relationship, and not be packed tightly, that is responsible for no discharge of filament during picking.

Figure 4:
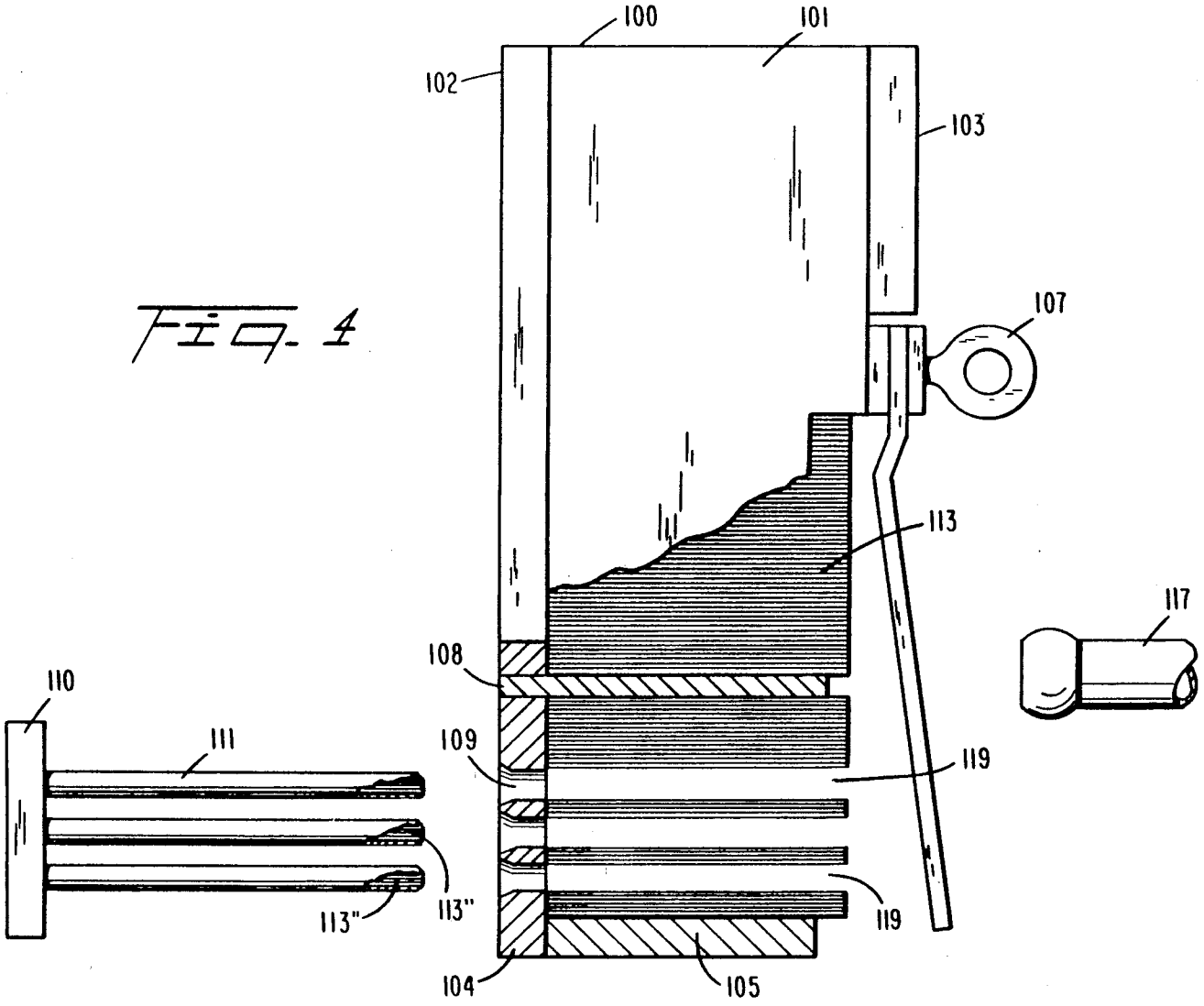
FIG. 4 is a side view of the picking device and filament stock box in partial cross-section illustrating the removal of filament from the stock box as contained within the picking elements.

FIG. 4 illustrates the attitude of the filament contained within the stock box 100 which is momentarily without the void 116 (space above the filament, but has voids 119 left by the removal of picking elements 111. The vibrating means was stopped prior to the withdrawal of the picking elements 111, and the filament 113 were retained within the individual elements 111.

Figure 5:
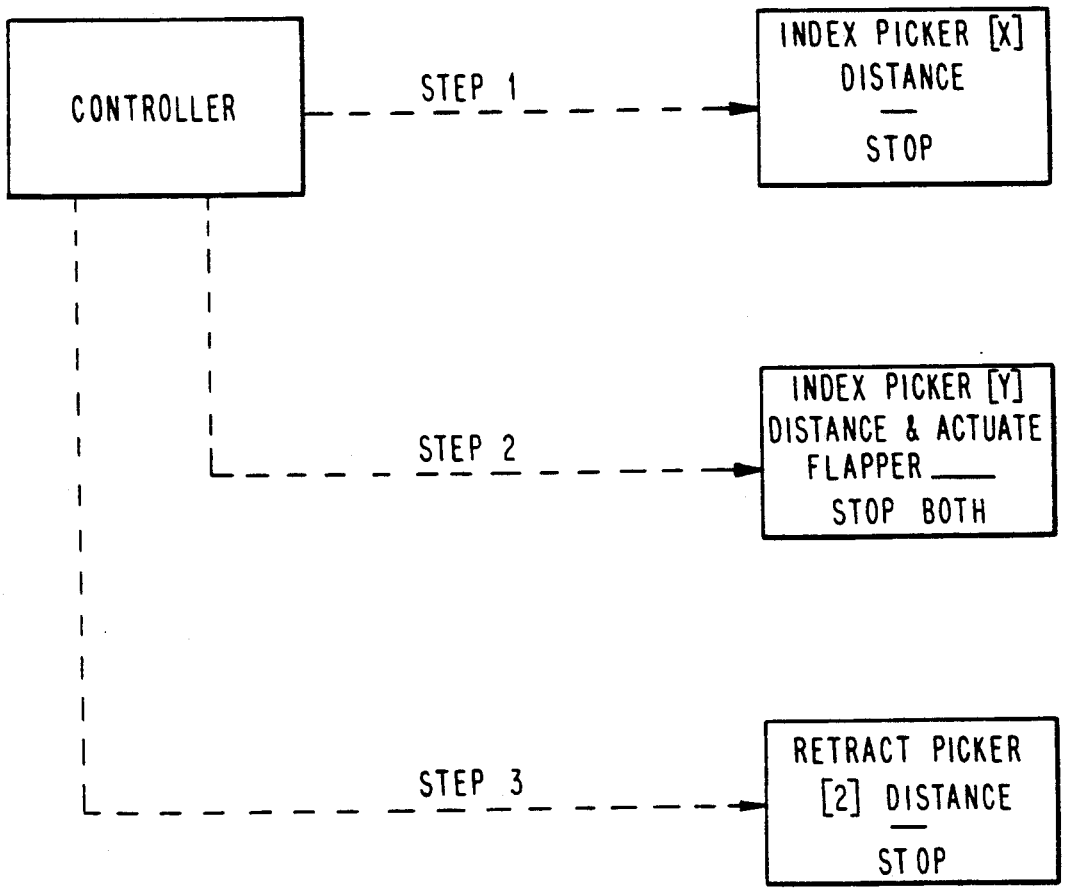
FIG. 5 is a typical schematic of a control system for this invention.

FIG. 5 illustrates the overall method of this invention with a control system which may include a conventional controller operably coupled to the picking device 110 and plate 106.

At this instant of time, either another empty picking device located on a multi-picking machine can be brought up to and positioned as in FIG. 1 in front of the filament stock box 100, in order for the whole process to start again, or the original picking device 110 can continue to a melting means and further fuse the filament 113 on to a pre-melted brush or broom block, thereby causing the fused filament tufts to be removed from the picking elements, and the empty picking device 110 brought back into alignment with the stock box 100 for another picking sequence.

The aforementioned illustration is only one of the many embodiments of this invention, and many varied index sequences may be employed However, the two stage index, whereby the first stage is to actually stop the forward motion of the picking device when the picking element is immediately in front of the filament's working end and said filament is then energized during picking has been found to be a vastly superior method. It allows the filament to orient and move about prior to entering the picking element opening, and does not cause individual filaments to be further engaged by the outer edge of the element, and pushed through the rear of the stock box.

As stated above, the stationary time between the first index and the continued second index can be in the range from 0.1 to 10.0 seconds whereby the picking element is actually through the aperture in the front face of said stock box, and at rest against the edges of the filament with the edges of filament and element touching. The speed and vibration of the second index can vary, for example, the speed of the index can be from 0.5 inch/second up to 10 inches/second, while the vibration or energizing means can oscillate forward and backward through 0.100 inches up to 1.5 inches. Also, the cycles per minute of the oscillations can vary from 10 cycles/second up to 2,400 cycles/minute. Either electrical and/or pneumatic energizing devices may be employed.

From the foregoing, it will be apparent to those skilled in the art that the instant invention provides a very simple and controlled means and method for picking and assembling filament tufts for subsequent fusing into brushes, brooms and the like as stated in the objects of the invention.

The invention may be embodied in other specified forms without departing from the spirit or essential characteristics thereto. The present embodiments are therefore to be considered in all respects as illustrative and not restrictive, the scope of the invention being indicated by the appended claims rather than by the foregoing description, and all changes which may come within the meaning and range of equivalency of the claims are therefore intended to be embraced therein.

I claim:

1. A method for picking at least one tuft of cut-to-length synthetic filament for use in brush construction comprising the steps of providing a stock box having a front plate having at least one aperture of predetermined cross section therethrough, side and bottom walls, said box containing cut-to-length synthetic filament in a parallel relationship extending perpendicular to said front plate, each filament having a cross section less than that of the aperture, said box having an open back; a flapper plate extending across the open back of said box and energizing means for causing said flapper plate to oscillate toward and away from said aperture plate against the ends of filaments adjacent thereto when said filaments are disposed therein; providing at least one elongated, hollow picking element having an open end for receiving filaments to form a tuft thereof; said element having the cross-sectional configuration of the aperture and being dimensioned to be received therethrough; indexing means coupled to said element for movement of said element through the aperture, through the stock box and for return movement thereof;

indexing said element a first distance forward through said aperture only until the open end thereof abuts the ends of filaments when such are disposed within said stock box;

stopping said forward movement;

subsequently energizing said flapper and indexing said element a second distance through said box to form a tuft of filaments thereinside;

stopping said forward movement and deenergizing said flapper; and retracting said element a third distance through said stock box and through aperture to remove said element containing said tuft of filaments from said box.

2. The method of claim 1 wherein said energized flapper oscillates at a distance of from 0.100 inches to 1.5 inches.

3. The method of claim 1 wherein said energized flapper oscillates from 10 cycles per second to 2400 cycles per minute.

4. The method of claim 1 wherein said second distance is indexed at a speed of from 0.5 to 10 inches per second.

5. The method of claim 1 further comprising providing a control means coupled to said indexing means and said energizing means for indexing said element said first distance forward, for subsequently stopping said forward movement; for energizing said flapper and for indexing said element said second distance through said stock box; and for stopping said forward movement and deenergizing said flapper; and subsequently for retracting said element the third distance to remove the picked tuft from said box.

* * * * *